United States Patent [19]

Sharar

[11] 4,213,299

[45] Jul. 22, 1980

[54] HEAT TRANSFER LENS STEAM TURBINE

[76] Inventor: Stephen T. Sharar, P.O. Box 236, Woodbury, Pa. 16695

[21] Appl. No.: 921,885

[22] Filed: Jul. 3, 1978

[51] Int. Cl.[3] ..... F01K 13/00

[52] U.S. Cl. ..... 60/676; 60/657; 60/669; 122/4 A; 122/40; 219/279; 290/2

[58] Field of Search ..... 60/643, 645, 657, 659, 60/660, 669, 670, 676; 122/4 A, 13 A, 40; 290/1 A, 46, 2; 219/279

[56] References Cited

U.S. PATENT DOCUMENTS

| | | | |
|---|---|---|---|
| 378,663 | 2/1888 | Davidson | 60/669 |
| 957,155 | 5/1910 | Gentle | 122/40 |
| 1,716,329 | 6/1929 | Simpson | 219/279 |
| 2,245,001 | 6/1941 | Miller | 60/669 |
| 2,949,731 | 8/1960 | Hambling | 290/2 X |

*Primary Examiner*—Allen M. Ostrager
*Assistant Examiner*—Stephen F. Husar
*Attorney, Agent, or Firm*—Thomas E. Sterling

[57] ABSTRACT

This invention relates to a steam turbine system which utilizes a unique heat-absorbing lens-shaped heating plate and boiler for the production of steam.

16 Claims, 9 Drawing Figures

Fig. 5.
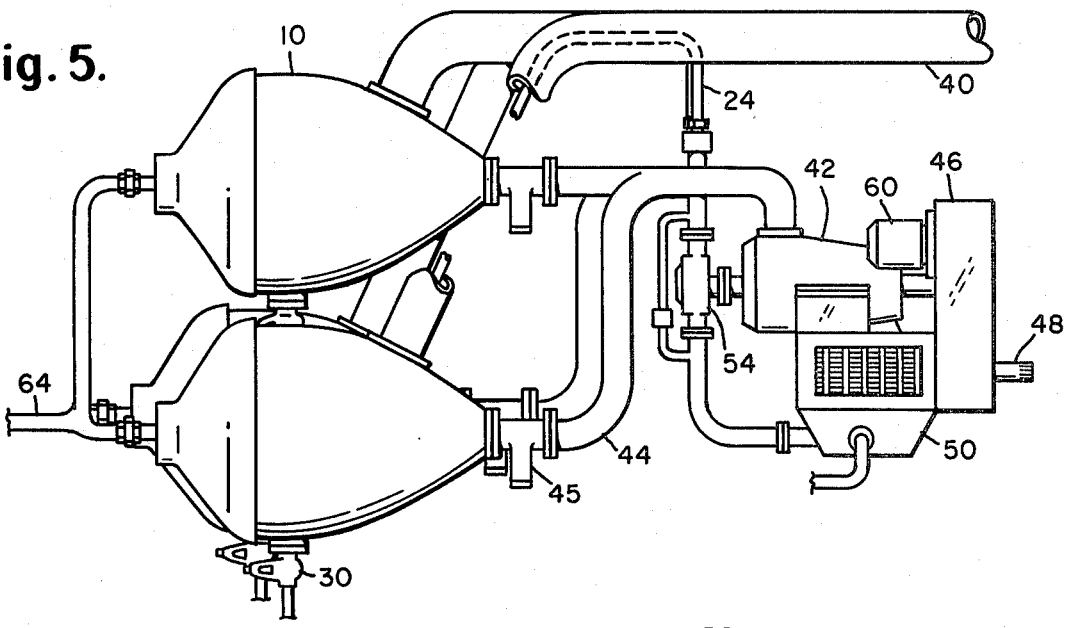
Fig. 6.
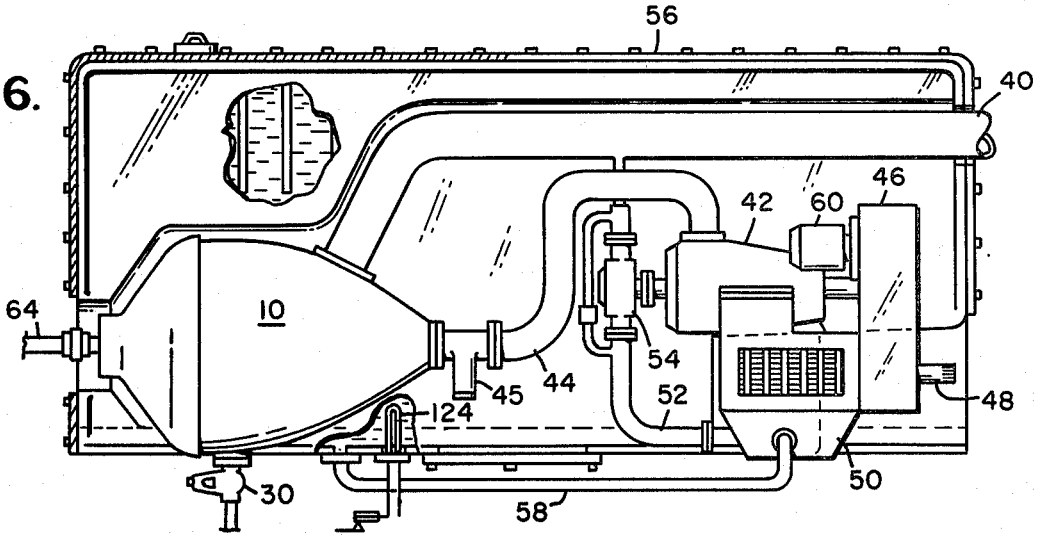
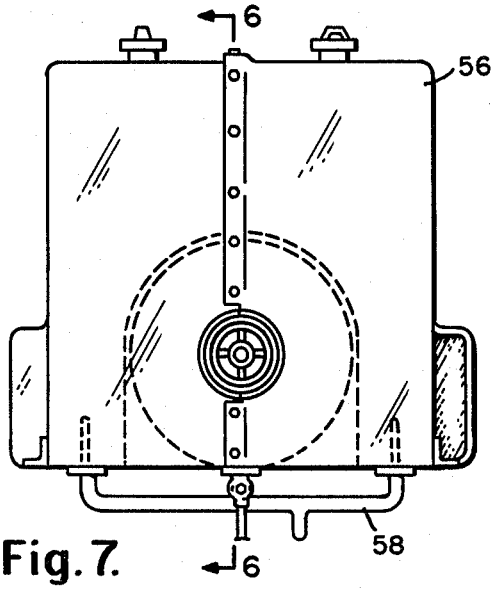
Fig. 7.
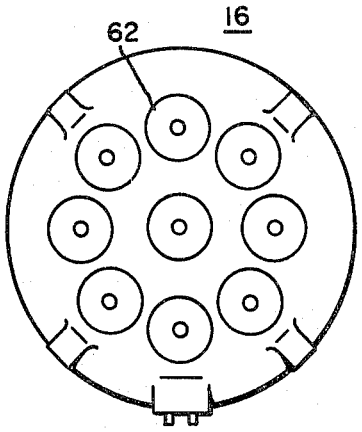
Fig. 4.

HEAT TRANSFER LENS STEAM TURBINE

PRIOR ART STATEMENT

The inventor knows of no prior art anticipating this invention. The inventor is not withholding known prior art which he considers anticipates this invention.

This invention relates to steam turbines and in particular to heat steam turbines utilizing a heat-absorbing lens-shaped heating plate.

The primary objective of the heat transfer lens principle is to provide a source of low cost, environmentally clean steam power for a variety of applications. These applications include, but are not limited to, railway locomotives, farm machinery, roadway tractors, marine powerplants, electrical power production facilities, industrial power plants, and for use as an automobile engine. Conveniently, any fuel available today may be used to heat the exterior lens area. Fuels such as gasoline, diesel fuel, number 2 heating oil, liquified petroleum (LP) gas, and talcumized coal are a few of the possibilities. LASER and fusion-processed fuel also hold promise for the near future.

Basically, the invention uses a highly heat-absorbent lens-shaped heating plate located in the large end of the plumb bob-shaped boiler to produce steam. Intense heat is applied to the convex exterior surface of the lens as atomized water is sprayed, under high pressure, at the concave interior surface of the lens. The result is instantaneous production of steam. As heat continues to be applied to the lens and as boiler pressure builds, at a prescribed value, a pressure control valve opens and delivers steam for use to either a turbine or a reciprocating piston.

Perhaps one of the most important features of this invention is the incorporation of an electric heating element as an integral part of the lens. The element and electrical connections are molded into the metals when the lens is manufactured and is used as the primary heat source to produce steam during those periods when large outputs of mechanical energy are not required. Energy to heat the element is supplied by a generator which is driven by the powerplant drive train. In the case of a stationary installation, standard (220 V) "house power" could be used in place of self-generated power, it desired.

The invention is generally comprised of a unique boiler whose steam lines are in connection with a conventional multi-vaned turbine. A gear-reducing mechanism is mechanically attached to the turbine to reduce the speed of rotation to a usable dimension. The turbine receives water from a water storage tank which surrounds and encases the boiler and turbine mechanism and thus serves as a noise-reducing mechanism. An object of this invention, therefore, is to provide a unique steam turbine operating engine.

Another object of this invention is to provide a steam boiler for a heat absorbent lens-shaped heating plate located therein.

Still another object of this invention is to provide a unique steam producing boiler.

These and other objects of the invention may be seen by referring to the following drawings in which:

FIG. 4 is a front view of the heat absorbing lens plate showing the areas of flame impingement thereon.

FIG. 5 is a side view partially in section of a cluster of three boilers of this invention attached to a steam turbine device.

FIG. 6 is a side view of the invention partially in section with one water tank removed.

FIG. 7 is a front view of the water tank of this invention.

Figure 2:
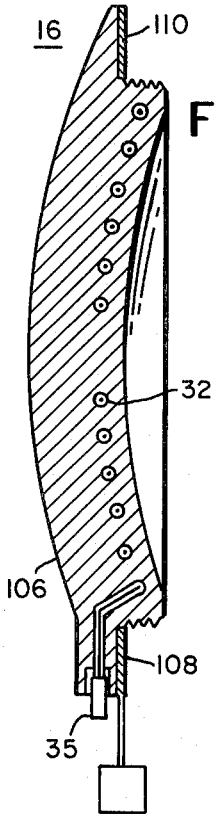
FIG. 2 is a section taken along line 2—2 of FIG. 1.
Figure 2A:
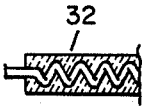
FIG. 2A is a cross-sectional view of the heating element in FIG. 1.
Figure 1:
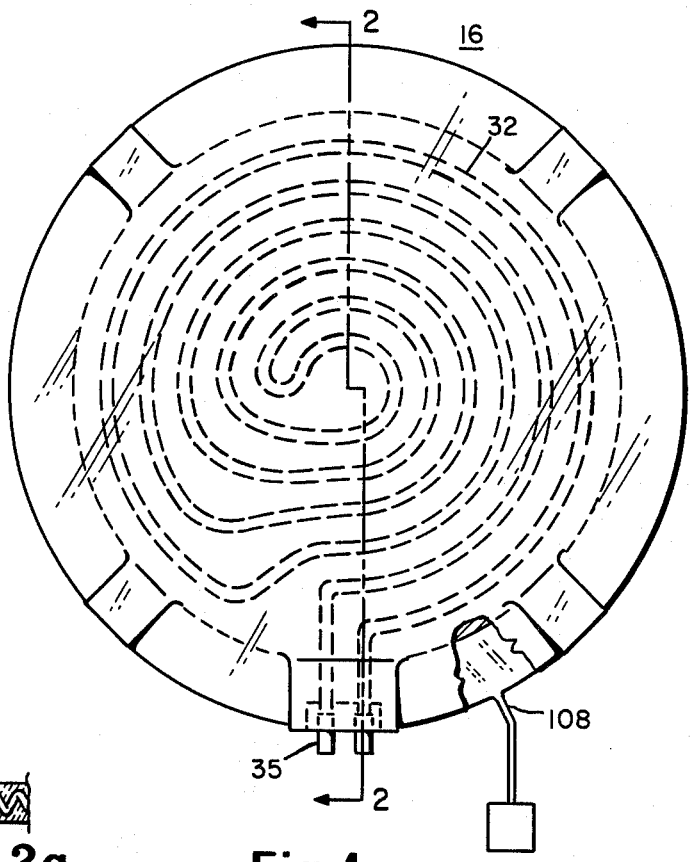
FIG. 1 represents a front view of the heat-absorbing lens-shaped plate positioned in the boiler of this invention.
Figure 3:
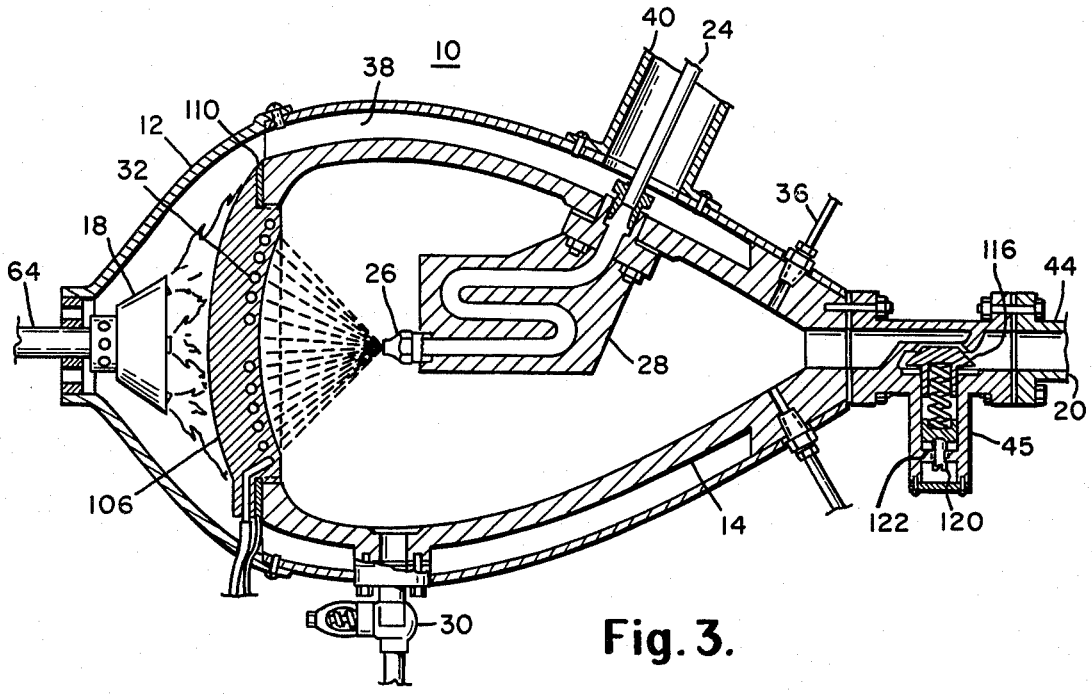
FIG. 3 is a cross-sectional view of the boiler of this invention.

Referring now to the invention and in particular to FIGS. 1, 2 and 3, there is seen boiler 10 comprised of outer shell 12 and inner boiler 14. One end portion of inner boiler 14 has concavo-convex shaped heat transfer lens 16 mounted thereon by threaded means. Fluted burner 18 is positioned in the outer shell 12 opposite heat transfer lens 16 and is designed to direct a blow torch-like flame into outer surface of heat transfer lens 16. The opposite end portion of inner boiler 14 has a steam delivery tube 44 mounted thereon which leads to the steam turbine 42. A water inlet line 24 passes through outer shell 12 and inner boiler 14 to a fluid atomizer 26 mounted in an inlet water mast 28 secured to inner boiler 14. The bottom portion of inner boiler 14 has a pressure relief and water drain valve 30 mounted thereon extending through outer shell 12. The interior portion of heat transfer lens 16 has a lens heater element 32 spirally positioned therein and a ring-shaped thermal sensor element 34 positioned on the threaded portion of lens 16 adjacent to inner boiler 14. An electrical output receptacle 35 leads from the heater element 32 from whence it is connected to a source of electrical power. A boiler pressure sensor 36 extends to within boiler 10 and burner exhaust outlet duct 38 is positioned between the outer shell 12 and inner boiler 14 and extends through an exhaust pipe 40 surrounding water inlet line 24. Exhaust pipe 40 leads to the outside.

Referring now to FIGS. 4, 5, 6 and 7, there is seen a boiler 10 connected to a multistaged turbine unit 42 through steam delivery tube 44. Turbine unit 42 is of the conventional multivaned type and is connected to a gear-reduction unit 46 which reduces the turbine speed to a power shaft 48. Shaft 48 may be connected to automotive drive train or the like (not shown). A steam condenser 50 is attached to the turbine unit 42 and condenses the exhaust steam from the turbine into water. Steam condenser 50 is also connected to a pump line 52 which leads to a positive displacement water pump 54. Water pump 54 is connected to water inlet line 24 which supplies water to the boiler 10. A water storage tank 56 encases the boiler turbine unit and thereby reduces the external noise of the device. Water storage tank 56 is constructed essentially of two lateral sections containing water together with a top plate and a bottom plate which provide access to the boiler and turbine area. A Y-shaped water supply line 58 connects the bottom of the two portions of the storage tank 56 to the steam condenser 50. A turbine starter motor/generator 60 is coupled to turbine 42 and acts as both a starter motor and generator to drive or be driven by the turbine. Referring now to FIG. 4, there is seen the front portion of heat transfer lens 16 showing the circular areas of impingement 62 of the flame from fluted burner 18.

Figure 8:
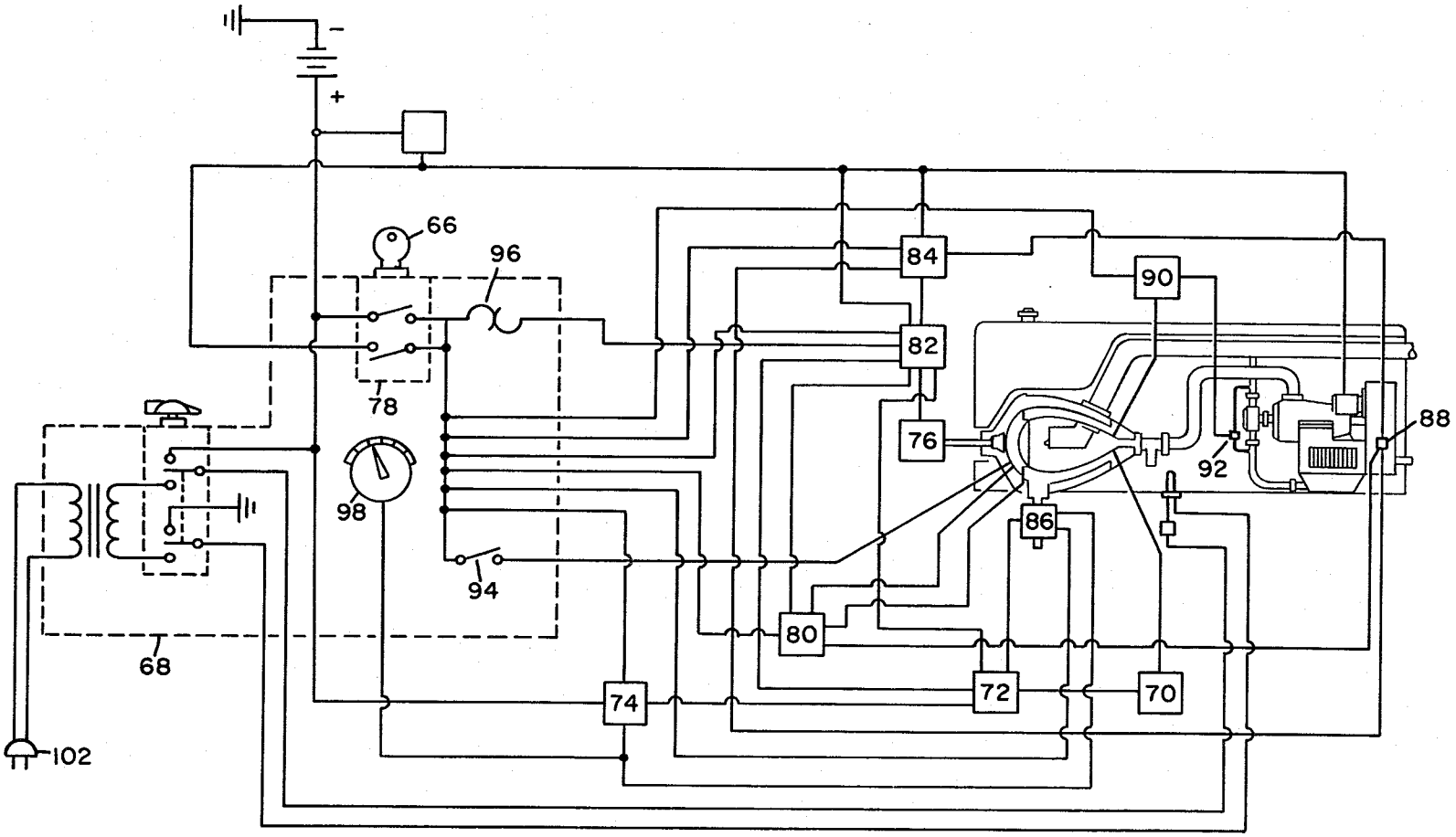
FIG. 8 is a block diagram of the varying electrical control units of the invention.

Referring now to FIG. 8 there is shown a circuit diagram of the controls for this invention. Their nomenclature, connection and purpose as pertains to automotive applications is fully set forth in the following listing:

| COMPONENT NO. | NOMENCLATURE | PURPOSE |
|---|---|---|
| 66 | Master switch | Connects battery and generator power to master control box (17) |
| 68 | Master control box | Distributes battery and generator power to components |
| 70 | Overpressure sensor control unit | Senses boiler overpressure conditions and initiates sequence of events to shut down boiler |
| 72 | Overpressure switching relay | Provides switching circuitry for overpressure shutdown |
| 74 | Time delay circuit | Provides time delay during overpressure conditions thus precluding immediate dumping of boiler pressure and automatic shutdown. Allows selective manual delay |
| 76 | Fuel metering valve | Meters fuel to fluted burner as directed by burner controller |
| 78 | Engine start switch | Provides connection between battery and engine for starting |
| 80 | Lens thermo control and start relay | a. Senses lens overheat and initiates action to reduce fuel flow to burner. b. Provides circuitry for turning lens heater element on and off |
| 82 | Burner controller and automatic shutdown relay | a. Provides control for metering of fuel by fuel metering valve. b. Provides circuitry for automatic shutdown of engine by cutting off fuel to burner and interrupting all electrical power to engine |
| 84 | Burner igniter and switching control relay | a. Provides power for ignition of fuel at burner. b. Provides switching power for igniter when required during normal operation, e.g. transition from burner operation to lens heater element operation and vice versa |
| 86 | Pressure relief and water drain valve | a. Relieves boiler pressure when overpressure condition exists and upon engine shutdown. b. Provides means of draining boiler of residual water |
| 88 | Torque sensing control unit | Senses power requirements and initiates action to switch from burner heating of lens to electrical heating of lens by heater element and vice versa |
| 90 | Waterpump pressure controller | Senses boiler pressure and maintains proper boiler pressure-water pressure ratio by controlling position of waterpump by-pass valve |
| 92 | Waterpump by-pass valve | Controls amount of water pressure delivered to boiler by by-passing water within pump to control pump outlet volume |
| 94 | Lens manual ON-OFF switch | Provides means to manually disrupt lens heater element operation |
| 96 | Master circuit breaker | Provides means of disconnecting all electrical power from engine (battery and generator), e.g. during emergency engine shutdown |
| 98 | Manual time delay selector | Provides means of maintaining boiler pressure during stop |

-continued

| COMPONENT NO. | NOMENCLATURE | PURPOSE |
|---|---|---|
| | | and go operations by keeping the pressure relief and water drain valve closed after normal engine shutdown |
| 100 | Watertank heater thermostat | Maintains water storage tank temperature at prescribed temperature to prevent freezing |
| 102 | External power plug | Self explanatory |
| 104 | Voltage regulator | Controls electrical system current and voltage flow |

The invention operation is further described as follows:

A. Engine Operation (motor vehicle)

Liquified petroleum gas delivered through burner supply line 64 is ignited at fluted burner 18 providing the energy necessary to heat lens 16. Fluted burner 18 is designed to provide even flame distribution over the entire surface area of the convex lens 16 exterior as indicated in FIG. 4. As the lens 16 approaches the initial stages of illumination, 12-volt electrical power is directed to starter motor/generator 60 which accelerates multi-stage turbine drive 42. The turbine drive unit 42, in turn, places positive displacement pump 54 into operation thus providing pressure to deliver water through water inlet line 24 to water atomizer/inlet water volume control valve 26. Atomized water under high pressure is then sprayed onto the concave interior surface of the lens 16 thus producing steam within inner boiler 14. As heat continues to be applied to the lens 16 by the burning gas, excess heat is exhausted through burner exhaust duct 38 which heats most of the exterior surface of the inner boiler 14 as well as water inlet mast 28. Steam pressure continues to build within the inner boiler 14 until the main steam pressure valve 45 opens at the prescribed pressure value. High pressure dry steam is thus delivered to the multistaged turbine 42 via steam delivery tube 44. Coincidental with the increase in boiler pressure, inlet water pumping pressure is increased allowing a corresponding increase in water flow through inlet water volume control valve 26. When valves 26 and 45 are completely open simultaneously, the ratio of inlet water to outlet steam is such that at no time will outlet volume produce rapid boiler pressure decay. Also incorporated within the boiler 10 is pressure relief/boiler drain valve 30. Should boiler pressure exceed a set maximum value, either through a malfunction of main steam pressure valve 45, or the inlet water volume control valve 26, valve 30 will automatically open and remain open until boiler pressure is reduced below the set maximum value. If valve 30 remains open and is unable to relieve excessive boiler pressure within a specified time period, automatic shutdown will occur by cutting off fuel to the fluted burner 18 and interrupting all electrical power to the boiler.

This process is expressed numerically in FIG. 8 by the following sequence of events in which each control unit activates the successive unit to which the arrow points.

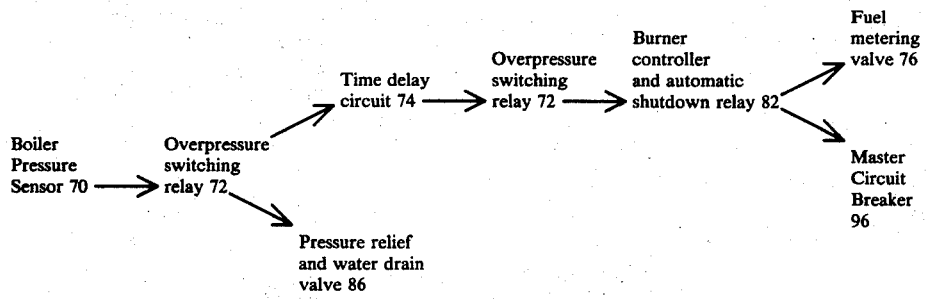

It should be noted that the normal position of valve 30 is open when electrical power is not applied to the inner boiler 14. This eliminates water from pooling when the engine is not in use and ensures that residual pressure does not exist inside the inner boiler 14. The exception to this rule is when it is desirous to sustain residual boiler pressure for short periods of time such as stop-and-go operations where retention of boiler pressure provides convenience. To accomplish this, a time delay device 74 is used which can be controlled from inside the vehicle.

This process is illustrated numerically by the use of FIG. 8 in the following manner in which each control unit activates the successive unit to which the arrow points.

| | | |
|---|---|---|
| Manual time delay selector 98→ | Time delay circuit 74→ | Pressure relief and water drain valve 86 |

Perhaps the most unique feature of this invention is the inclusion of a high resistance heating element 32 as an integral part of the heat transfer lens 16. The purpose of the heating element is to allow the engine to be self-sustaining for periods of time and to supply added heat energy when maximum steam pressure is required. Power to heat element 32 is supplied by a generator 60 which is driven from the turbine 42. After the boiler 10 has reached normal operating pressure and torque has stabilized, the heating element 32 is energized and the gas burner 18 is shut down. The heating element 32 remains the primary lens heat source until significant boiler pressure decay occurs. At this point, the gas burner 18 is reignited and the process repeats itself.

This sequence of events is illustrated on FIG. 8 in the following manner:

a. For lens heating element operation

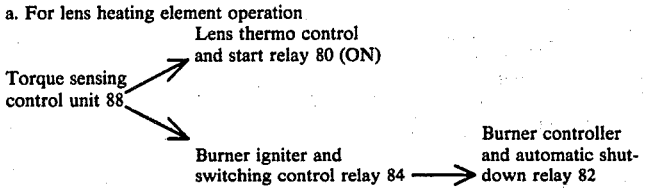

b. For burner relight

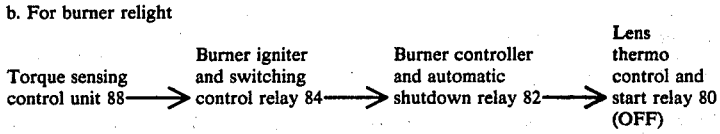

During level cruise conditions, the heating element 32 will be capable of supplying sufficient heat to operate the powerplant for limited periods of time thus negating the need to burn stored fuel. As a result, the engine is extremely economical to operate and is emission free during this phase of operation. If the engine enjoys widespread use, it will contribute significantly to the reduction of environmental pollution.

B. Engine Installation

When used in an automobile, the engine can be installed as a single unit or grouped in a cluster of 2, 3 or 4 units as seen in FIG. 5, depending on power and design requirements. However, regardless of the number of units used, the inherent simplicity of the engine makes it easy to mount to the chassis on sliding rails (not shown) since excessive vibration due to reciprocative motion is not a problem. When installed in this manner, the entire unit can be disconnected from the drive train in a matter of minutes, slid forward on its rail mounting, and be serviced or removed from the vehicle with ease.

The design characteristics include the following:

a. Convex exterior lens surface 106 where the primary heat source is applied via the fluted burner 18.

b. Electrically heated heating element 32 which is used during periods when high engine power output is not required; e.g. during periods of level cruise operation (motor vehicle use). Operational control of the element 32 will be both manual (ON-OFF switch at operator's station) and automatic (torque sensor on drive unit). The automatic feature will measure actual torque applied at the torque converter 46 drive shaft compared to the maximum potential torque the powerplant is capable of producing. When power requirements reach a fixed precomputed value which is capable of sustaining drive unit momentum, the heating element 32 will automatically be placed in operation and the fluted burner 18 will shut down.

This process can be explained by following the sequence of events numerically as illustrated in FIG. 8.

(a) To place lens heater element in operation:

| | | | | |
|---|---|---|---|---|
| Lens manual ON-OFF switch 94 ON, → | Torque sensing control unit 88 → | Lens thermo control and start relay 80→ | Burner controller and automatic shutdown relay 82 → | Fuel metering valve 76 |

(b) To relight burner due to increase in power/torque requirement:

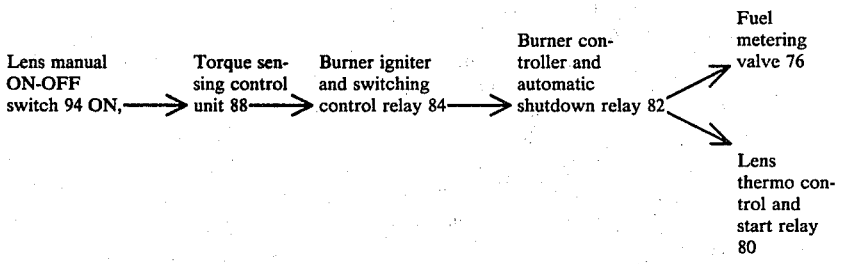

The use of rail mountings and quick disconnect electrical, fuel and water lines will significantly reduce maintenance downtime and, therefore, reduce maintenance costs.

HEAT TRANSFER LENS

The heart of the heat transfer lens steam powerplant is the lens 16. The design, construction materials, and fabrication are extremely important to the success of the principle. Not only is it important that the lens 16 be heated to operating temperature in a matter of seconds, but it must be constructed of materials which will produce a service life equivalent to the time before overhaul (TBO) of present day diesel engines. Therefore, the materials used in the construction of the lens must absorb heat rapidly while resisting physical distortion.

c. Threaded attachment area.

The threaded section on the periphery of lens 32 provides a means of securing the lens to the mating boiler thread 14.

d. Flange area

The flange area 110 of lens 16 adjacent to the threaded section provides a surface for the inclusion of a ring-shaped thermal sensor 108 between the lens 16 and the inner boiler 14. The sensor will provide a seal between the lens and the boiler and aid in the removal of the lens from the boiler, as well as function as a heat-sensing device.

e. Electrical outlet receptacle

This receptacle 35 provides a means of connecting electrical power to the element and an outlet for other electrical connections such as temperature sensors, etc. It is constructed of ceramic material to eliminate destruction by intense heat and to insulate generator electrical output from the lens.

f. Lens interior surface

The interior surface of the lens performs the function of providing a heated surface on which to transform atomized water into superheated steam. It is desirable that the lens surface be heated to the maximum temperature possible consistent with the capability of the metals, therefore, producing steam at the maximum temperature possible. The shape of the interior surface is slightly concave to conform to the general curvature of the outer surface. In this manner a constant thickness is guaranteed throughout those portions of the lens where direct heat is applied.

FLUTED BURNER

The purpose of the fluted burner 18 is to supply heat to the convex outer surface 106 of the lens 16 in a systematic manner. That is, to control the burning pattern so that the lens is heated as evenly and as rapidly across its entire surface as possible. To accomplish this task, the exterior area 106 of the lens 16 is divided into equal segments beginning at the center and extending outward to the attachment thread line as may be seen in FIG. 4. The center of each segment then becomes the point of alignment for each of the burner 18 orifices. When the burner 18 is properly aligned with respect to the lens 16, the flame pattern provides a number of evenly defined areas 62 on the surface of the lens where maximum heat application occurs. From each area of flame contact, the absorbed heat radiates in a circular manner outward to meet other adjacent radiation patterns. The net result is extremely rapid heating of the lens with minimum use of stored fuel. To insure that hot spots do not progress to the point of melting or permanently distorting the lens 16, a ring-shaped heat sensor 108 is placed between the lens and the boiler flange area 110 which is connected electrically to the burner controller so that heat application can be controlled by varying the amount of gas supplied to the burner 18 orifices.

This process is illustrated numerically in FIG. 6 by the following sequence of events:

| From lens | Lens thermo control and start relay 80→ | Burner controller and automatic shutdown relay 82→ | Fuel metering valve 76 |
|---|---|---|---|

WATER ATOMIZER/INLET WATER VOLUME CONTROL VALVE

The purpose of the valve 26 is to meter and atomize water under varying pressure values to it can be sprayed onto the interior surface of the lens 16 with maximum efficiency. Since water pressure is supplied by a positive displacement pump 54 which is capable of extremely high pumping pressure, control of this pressure must be regulated so that pressure at the nozzle remains at a constant value in excess of internal boiler pressure. To accomplish this, pressure sensors 36 installed inside the boiler supply the necessary information to an electronic control unit, which in turn opens or closes a by-pass valve (not shown) within the pump, thus regulating pump output volume/pressure.

This process is illustrated numerically in FIG. 6 by the following sequence of events:

| Boiler sensor | Waterpump pressure controller 90→ | Waterpump by-pass valve 92 |
|---|---|---|

Since atomization of water is accomplished by restricting the size of the water outlet orifice on the boiler end of the water atomizer/inlet water volume control valve 26, it is necessary to control the size of the orifice. If it is not controlled under high pumping pressure, water will be atomized to the point that it will not reach the lens as small droplets of water. Therefore, a spring operated needle valve (not shown) and seat are used to control atomization. As water pressure increases, it forces the needle valve farther from its seat thus increasing the flow of water and controlling the atomization process. The net result of controlling water pump pressure and water inlet volume and vaporization pattern is the maintenance of a proper inlet water volume to boiler pressure ratio.

During the starting cycle, water pump pressure is allowed to remain at a fixed value until boiler pressure build-up approaches the desired ratio. At that point, pumping pressure increases to accommodate the ratio.

MAIN STEAM PRESSURE VALVE

The purpose of the main steam pressure valve 45 is to deliver superheated dry steam for the purpose of accomplishing a desired mechanical task. For the purpose of this discussion, we will assume that a multi-stage turbine 42 is the unit being directly driven by steam pressure through the valve 45.

In order to supply steam pressure to the turbine blades (not shown) so that the turbine 45 accelerates to the proper RPM, a control valve 45 is placed in the small end of the boiler 10. As boiler pressure increases to the prescribed value, it overcomes spring tension and the valve 45 slowly unseats, thus allowing high pressure steam to pass by the valve and into the steam delivery tube 44.

The valve consists of a valve seat 116 which has a machined surface that is mated to a like surface on the boiler, and a coil spring 118 of predetermined strength which holds the valve head 116 tightly against the boiler opening. In the interest of simplicity and reliability, the valve is designed as a mechanically operated device which can be removed from the boiler for cleaning or replacement. In addition, adjustment of spring tension can be accomplished with the valve in place by increasing tension against the spring 118. This is done by rotating a threaded screw 120 attached to a backing plate covering the aft end of the spring. The screw passes through the center of the spring and into the valve 45 body. Clockwise rotation of the screw 120 compresses the spring 118 thus increasing tension against the valve head 116. Counterclockwise rotation produces the opposite result.

WATER STORAGE TANK

One of the most important considerations in steam turbine 42 operation is the reduction of powerplant noise. Characteristically, high speed turbines exhibit a high noise profile which make them a health hazard if proper protection is not employed. To insure that noise pollution is reduced to a minimum, the water storage tank 56 is used as a noise insulator. That is, the entire engine and turbine drive unit are surrounded by the tank. The reservoir is constructed in much the same manner as a thermos bottle container except that sound deadening materials are used in the fabrication of the interior and exterior walls. Engine noise must penetrate the interior wall, then the water, and finally the exterior wall before exiting the engine enclosure. If proper construction techniques are used, very little noise will be heard throughout engine operating parameters.

In addition to its use as a sound deadener, the thermos style construction provides a means of insulating engine water from cold temperatures. The installation of small heater elements 124 (probes) in the bottom of the tank will guard against hard freezing and subsequent tank damage. These probes will be designed to operate on engine electrical power system (DC battery of the engine) or 110 volt "house" power.

The water storage tank 56 will be constructed in four sections. That is, two water storage sections and two maintenance cover plates; one on top the powerplant providing access to the forward turbine section, and one directly beneath to provide access to the lower turbine section and condenser area. Both panels are constructed of sound deadening materials and employ quick release fasteners for ease of removal. The use of two water cells will provide redundancy and thus insure a supply of water should one tank malfunction or become damaged. Each tank has an independent water supply line 58 which joins together by use of a "Y" fitting at the lowest point of the tank installation.

I claim:

1. A steam turbine device comprising in combination:
- an outer boiler shell;
- an inner boiler positioned within said outer boiler shell;
- a heat transfer lens device positioned in the end portion of said inner boiler;
- a jet burner device positioned in said outer boiler shell, adjacent to said heat transfer lens device and adapted to directing a flame against said heat transfer lens device;
- a spraying mechanism positioned within said inner boiler adjacent to the inner portion of said heat transfer lens device, said spraying mechanism being in communication with a reservoir of fluid;
- a steam delivery tube in communication with said inner boiler;
- a steam pressure valve positioned within said steam delivery tube and adapted to control steam there passing through;
- a steam turbine connected to said steam delivery tube;
- a steam condenser connected to said steam turbine and adapted to condense steam from said turbine;
- a gear reduction unit connected to said turbine adapted to convert the rotation speed of said turbine;
- a combination starter-motor and generator unit connected to said turbine, said motor and generator unit connected specifically to the gear reduction unit of said steam turbine and adapted to (1) rotate said turbine for starting purposes and (2) to generate electrical energy;
- a water pump connected to said condenser and in communication with said fluid-spraying mechanism;
- a control mechanism associated with said water pump and adapted to control the fluid pressure output of said water pump and a water storage tank encasing said outer boiler shell and said turbine, said water tank being in communication with said condenser;
- a control system adapted to monitor and control the operation of said inner boiler and said turbine.

2. The combination as claimed in claim 1 in which said heat transfer lens is comprised of in combination:
- a concave-convex shaped lens adapted to receive heat on one side portion and to transmit heat to the other side portion;
- electrical heat elements in contact with said lens;
- a source of electrical power connected to said heat elements.

3. The combination as claimed in claim 2 in which said heating elements are positioned within said lens in a spiral shape.

4. The combination as claimed in claim 3 in which said source of electrical power is said motor-generator.

5. The combination as claimed in claim 4 in which said source of electrical power is an electrical house plug.

6. The combination as claimed in claim 5 in which said lens has a temperature-sensing element in contact therewith, said temperature-sensing element comprising a concentric ring positioned between said lens and said inner boiler.

7. The combination as claimed in claim 6 in which said inner boiler has a pressure relief valve thereon, said valve adapted to open when sufficient pressure develops within said boiler.

8. The combination as claimed in claim 7 in which said inner boiler has a pressure-sensing device positioned thereon.

9. The combination as claimed in claim 8 in which said fluid spraying mechanism is mounted within said boiler by a support mast connected to said inner boiler.

10. The combination as claimed in claim 9 in which the operation of said steam turbine device is controlled by a central control system.

11. The combination as claimed in claim 10 in which said burner is adapted to direct flame against said lens surface in a uniform manner.

12. The combination as claimed in claim 11 in which said fluid storage tank has electrical heating elements positioned therein adapted to prevent said fluid from freezing.

13. The combination as claimed in claim 12 in which said burner heating elements, water pump, steam pressure valve, pressure relief valve, burner and turbine are connected to said central control system.

14. The combination as claimed in claim 13 in which a plurality of inner boilers are in communication with said turbine.

15. In a steam-producing boiler, a heat transfer lens device comprising in combination:
- a concave-convex shaped lens plate attached to receive heat on one side portion thereon and to transmit heat from the other side portion thereof;
- electrical heating elements positioned within said lens and attached to heat said lens;
- a heat-producing source on one side of said lens attached to heat said side portion of said lens;
- a fluid-spraying source on the side portion of said lens opposite that of said heat-producing source, said fluid spraying source being water-spraying orifice attached to spray fluid upon said lens.

16. The combination as claimed in claim 15 in which said heating elements are spirally positioned within said lens.

* * * * *